US007642445B2

(12) United States Patent
Izumisawa

(10) Patent No.: US 7,642,445 B2
(45) Date of Patent: Jan. 5, 2010

(54) MUSIC SOUND GENERATOR

(75) Inventor: Gen Izumisawa, Hamamatsu (JP)

(73) Assignee: Kabushiki Kaisha Kawai Gakki Seisakusho, Shizuoka (JP)

( * ) Notice: Subject to any disclaimer, the term of this patent is extended or adjusted under 35 U.S.C. 154(b) by 147 days.

(21) Appl. No.: 11/874,166

(22) Filed: Oct. 17, 2007

(65) Prior Publication Data

US 2008/0245213 A1 Oct. 9, 2008

(30) Foreign Application Priority Data

Oct. 19, 2006 (JP) ..... 2006-285484

(51) Int. Cl.
*G10H 1/06* (2006.01)

(52) U.S. Cl. ..... 84/622; 84/626; 84/627; 84/659; 84/661; 84/662; 84/663

(58) Field of Classification Search ..... None
See application file for complete search history.

(56) References Cited

U.S. PATENT DOCUMENTS

| | | | | |
|---|---|---|---|---|
| 7,476,797 | B2 * | 1/2009 | Izumisawa et al. | 84/660 |
| 2005/0211074 | A1 * | 9/2005 | Sakama et al. | 84/626 |
| 2007/0175318 | A1 * | 8/2007 | Izumisawa et al. | 84/626 |
| 2009/0031886 | A1 * | 2/2009 | Iwase | 84/661 |

FOREIGN PATENT DOCUMENTS

| | | |
|---|---|---|
| JP | 2001-236067 | 8/2001 |
| JP | 2007193129 A | 8/2007 |
| JP | 2007193130 A | 8/2007 |

OTHER PUBLICATIONS

Patent Abstracts of Japan, Publication No. 2001-236067; Date of Publication: Aug. 31, 2001; in the name of Masao Kondo.

* cited by examiner

*Primary Examiner*—Marlon T Fletcher
(74) *Attorney, Agent, or Firm*—Christie, Parker & Hale, LLP.

(57) ABSTRACT

A music sound generator imitates released key string vibration sounds (RKSV) and cabinet resonances of an acoustic piano. When a key is pressed, waveform is readout from a normal music sound waveform memory 15. The normal sound waveform is inputted into a filter 21, and inputted into a filter 22 through a band-pass filter 33. Output waveform of a cabinet resonance waveform memory 17 is inputted into a filter 23 when the key is pressed. Outputs of the filters are synthesized by an adder 27 through multipliers 24 through 26. When the key is pressed, a cut-off frequency of the filter 22 is sufficiently low and RKSV is not generated. If the damper is not on when key-releasing, the cut-off frequency is returned to normal and RKSV is generated. A level controller 32 attenuates the RKSV and the cabinet resonance for a longer time than the normal music sound.

30 Claims, 6 Drawing Sheets

MUSIC SOUND GENERATOR

CROSS-REFERENCE TO RELATED APPLICATION

This application claims priority of Japanese Patent Application Number 2006-285484, filed on Oct. 19, 2006.

BACKGROUND OF THE INVENTION

1. Field of the Invention

The present invention relates to a music sound generator, more specifically, to a music sound generator suitable for imitating an effect sound when releasing a key of an acoustic piano.

2. Description of the Related Art

In an acoustic piano, a damper is used to suppress vibration of piano strings other than the time of pressing a key. When depressing the key, first, an action works and then a damper corresponding to the depressed key is released. Second, a hammer strikes the strings to generate a piano sound. When stopping the pressure on the key and returning the key to the original state, the action works in reverse, the released damper comes into contact with the strings again to suppress vibration, and the piano sound is stopped. At the time of this stop of the piano sound, the damper comes into contact with the strings being vibrated, so that a delicate string vibration sound different from the normal music sound is generated although duration of the vibration sound is short. Hereinafter, this string vibration sound will be referred to as "released key string vibration sound."

The damper is not provided for all strings, and for strings of one and a half octaves on the high note side, no damper is provided and the strings are always released. Even in the case of strings for which a damper is provided, portions (fore strings and back strings) of the strings which are not vibrated normally are equivalent to always be in a released state regardless of the working of the damper.

Due to these released strings and frame, etc., the acoustic piano slightly resonates. Therefore, when a piano sound is generated by striking a key, a delicate resonance of the piano itself is added to the piano sound. This resonance is masked by the piano sound and cannot be heard while key pressing, however, it is understood that it remains when the key is released and the piano sound stops. This resonance will be referred to as "cabinet resonance."

Conventionally, attempts were made to imitate a released key string vibration sound and a cabinet resonance by an electronic instrument such as an electronic piano. For example, a released key string vibration sound of a normal music sound generated by pressing a key is imitated by setting a longer attenuation time when releasing the key.

In addition, there is known a music sound generator (Japanese Published Unexamined Patent Application No. 2001-236067) which when key-off information is supplied, can deaden a main music sound being generated and generate a key-off sound instead of a released key string vibration sound or a cabinet resonance. In this music sound generator, when key-off information is supplied, characteristics of a main music sound at a pitch instructed by the key-off information are detected, and the detected characteristics of the main music sound are set as characteristics of a key-off sound. This music sound generator determines characteristics of a key-off sound according to the time from key-on to key-off.

However, a sound generated when releasing a key of an acoustic piano contains an element that is not generated normally while sounding, so that even if the attenuation time when releasing the key is set to be longer, the characteristic sound when releasing the key cannot be sufficiently reproduced. In addition, in the method described above in which a key-off sound is newly generated when releasing the key, a new system for generating a music sound in response to key-releasing is necessary. Furthermore, to maintain the continuity of the normal music sound, the key-pressing time and normal music sound volume, etc., must be managed and effect sounds generated responsively must be controlled, so that the control becomes complicated and enormous in scale.

SUMMARY OF THE INVENTION

In view of the problem described above, an object of the present invention is to provide a music sound generator which can reproduce a delicate sound such as a released key string vibration sound and a cabinet resonance.

In order to solve the problem and achieve the object, a first aspect of the present invention is as follows. First, in response to a sound start instruction, a normal music sound signal and a released key string vibration sound signal are provided with predetermined envelopes for start of sound production, and a cut-off frequency of the released key string vibration sound signal is set sufficiently lower than normal. Then, in response to a sound stop instruction outputted based on key pressing information (key-off signal) and operation device information, the normal music sound signal and the released key string vibration sound signal are attenuated according to the predetermined envelopes, and on the other hand, the cut-off frequency set to be lower of the released key string vibration sound signal is returned to normal. The released key string vibration sound signal is generated by filtering waveform data of the normal music sound signal by a band-pass filter or the like.

The present invention has a second aspect in that filtering using the band-pass filter or the like is applied to mixed signals of signals of all channels for generating released key string vibration sounds.

The present invention has a third aspect in that filtering using the band-pass filter or the like is performed by using a filter having filter characteristics that change by each predetermined register.

The present invention has a fourth aspect in that, in response to a sound production start signal outputted based on key-pressing information, a normal music sound signal and a cabinet resonance signal are started to be generated.

The present invention has a fifth aspect in that the number of sounds simultaneously produced of the released key string vibration sounds or cabinet resonances are set to be smaller than the number of sounds simultaneously produced of normal music sounds.

The present invention has a sixth aspect in that when the released key string vibration sound generating means is short of an unused channel, one of the released key string vibration sound signals whose sounds are being produced is stopped, and when the cabinet resonance generating means is short of an unused channel, one of the cabinet resonance signals whose sounds are being produced is stopped and the attenuation time when stopping the production of this stopped released key string vibration sound signal or a normal music sound signal started to be generated simultaneously with a cabinet resonance signal is set to be longer.

The present invention has a seventh aspect in that the shortage of the unused channel is judged at the time of output of a sound start instruction outputted by the sound instructing means.

The present invention has an eighth aspect in that when an unused channel is in short supply, a released key string vibration sound signal and cabinet resonance signal to be stopped is determined by placing priority on a lower pitch sound or a higher pitch sound or a later-pressed sound.

The present invention has a ninth aspect in that the released key string vibration sound generating means and the cabinet resonance generating means are provided for a preset specific key or key range.

The present invention has a tenth aspect in that it is equipped with a means for providing envelopes in which an attenuation time of the released key string vibration sound signal or cabinet resonance signal to be attenuated in response to the sound stop instruction is set to be longer than that of the normal music sound signal.

The present invention has an eleventh aspect in that cabinet resonance waveform data is synthesized according to a single-degree-of freedom system model with viscous damping.

The present invention has a twelfth aspect in that the reading start point of a normal music sound waveform for generating a released key string vibration sound from a normal music sound waveform storing means is shifted from the head to the rear.

According to the first aspect of the present invention, a normal music sound signal and a released key string vibration sound signal provided with envelopes are generated at the time of key-pressing. However, the cut-off frequency of the released key string vibration sound signal is sufficiently lowered, so that the released key string vibration sound is not produced in actuality at the time of key-pressing, and when the cut-off frequency is returned to normal at the time of key-releasing, the released key string vibration sound is started to be produced actually. Instead of generating a released key string vibration sound by starting reading waveform data at the time of key-releasing, a released key string vibration sound signal is generated in advance based on a normal music sound waveform at the time of key-pressing, whereby a released key string vibration sound based on the real one according to an amplitude that gradually changes since key-pressing can be generated at the time of key-releasing. Therefore, it is not necessary to manage the key-pressing time until key-releasing and a volume of the normal music sound, etc.

A sound stop instruction is outputted based on both of key-pressing information and operation device information, so that even at the time of key-releasing, if a damper pedal as the operation device is stepped on, a sound stop instruction is not outputted, so that a released key string vibration sound cannot be prevented from being produced. Then, after key-releasing, when the operation of the damper pedal is stopped, a sound stop instruction is outputted at this time, so that a released key string vibration sound can be generated. Even in an acoustic piano, when the damper pedal is turned off after key-releasing, the damper comes into contact with the vibrating strings and generates a string vibration sound, so that the imitation of the first aspect is suitable for imitating the sounds of an acoustic piano.

The released key string vibration sound signal is formed by filtering a normal music sound waveform with a band-pass filter or the like, so that it is not necessary to store a released key string vibration sound waveform for generating a released key string vibration sound signal in advance, and the area of the waveform memory can be reduced.

According to the second aspect of the present invention, only one band-pass filter or the like as a released key string vibration sound signal generating means is provided for a plurality of released key string vibration sound generating channels, so that the circuit scale can be further reduced.

According to the third aspect of the present invention, a released key string vibration sound suitable for a register can be generated by selecting a filter whose filter characteristics change by register.

According to the fourth aspect of the present invention, a normal music sound signal and a cabinet resonance signal are generated when pressing a key. In an acoustic piano, the cabinet resonance is generated at a small level since key-pressing, and according to the fourth aspect, this cabinet resonance can be imitated.

According to the fifth aspect of the present invention, a released key string vibration sound and a cabinet resonance can be imitated without greatly increasing the number of music sound generating channels.

According to the sixth aspect of the present invention, when the number of channels for generating a released key string vibration sound and a cabinet resonance is in short supply, priority is placed on a new sound start instruction, and one of the sounds being produced is stopped. Then, imitation can be made by setting parameters so that the attenuation time of a normal music sound when production thereof is stopped becomes longer instead of the stopped released key string vibration sound and cabinet resonance. Thereby, the small number of channels can be complemented.

According to the seventh aspect of the present invention, the shortage of channels can be judged at the time of output of a sound start instruction and the attenuation time of a normal music sound signal can be set to be longer in advance.

According to the eighth aspect of the present invention, priority is given to a low pitch sound whose string vibration amplitude is great, and a high pitch sound whose cabinet resonance is remarkable, or a sound newly produced. This priority is given to prevent generation of loud released key string vibration sound and cabinet resonance of the upper register with a small string vibration amplitude and a sound that is started earliest.

According to the ninth aspect of the present invention, for example, in conformity with an acoustic piano in which a damper is not provided for the upper register, it is possible that the released key string vibration sound generating means is not provided for the upper register.

According to the tenth aspect of the present invention, an acoustic piano can be highly accurately imitated while maintaining an attenuated sound of the released key string vibration sound signal and the cabinet resonance signal even after the attenuation of a normal music sound is completed.

According to the eleventh aspect of the present invention, a cabinet resonance can be generated at the time of key-pressing based on cabinet resonance waveform data created by using a single-degree-of freedom system model with viscous damping.

According to the twelfth aspect of the present invention, by reading only the head of the normal music sound waveform data, that is, only a loop excluding an impact noise of key-pressing, a released key string vibration sound less influenced by the rise of the normal music sound can be obtained.

DETAILED DESCRIPTION OF THE PREFERRED EMBODIMENT

Figure 2:
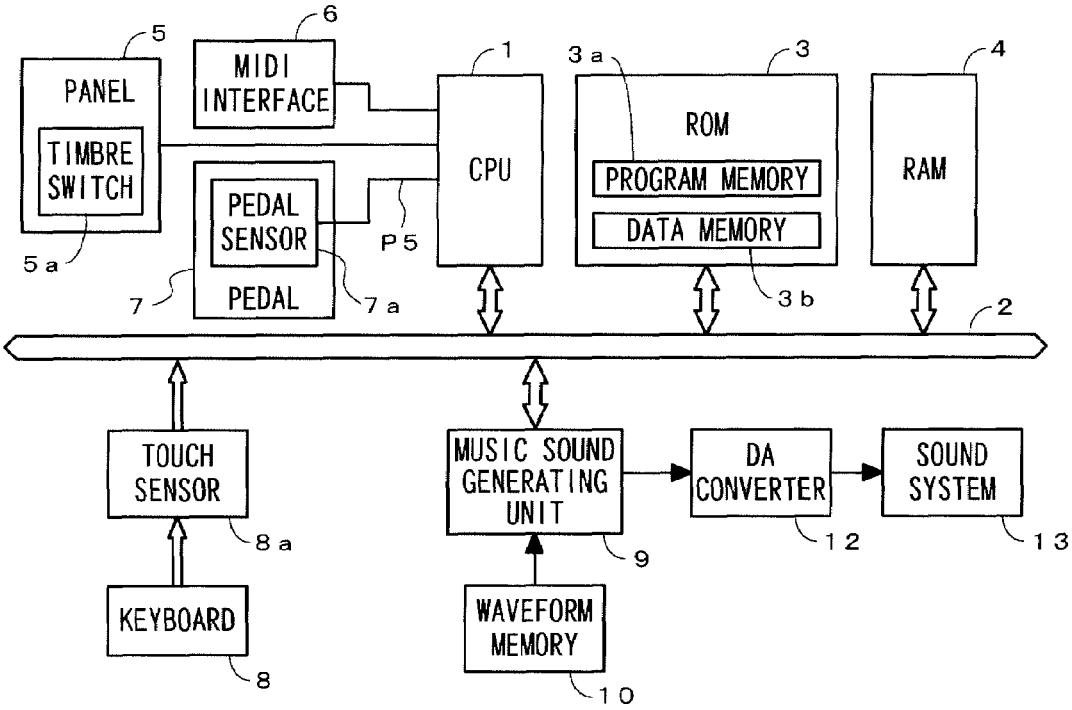
FIG. 2 is a block diagram showing a hardware construction portion of the music sound generator of the embodiment of the present invention.

Hereinafter, the present invention will be described in detail with reference to the drawings. FIG. 2 is a block diagram showing a hardware construction of an electronic piano as an example of a music sound generator according to an embodiment of the present invention. In this figure, the CPU 1 controls the respective parts shown in the figure via a system bus 2. The system bus 2 includes an address bus, a data bus, and a control signal line. The ROM 3 includes a program memory 3*a* which stores programs to be used in the CPU 1 and a data memory 3*b* which stores various data containing at least tone data. The RAM 4 temporarily stores various data, etc., generated in control by the CPU 1.

This electronic piano is provided with an operation panel (hereinafter, referred to as "panel" simply) 5, a MIDI interface 6, and a damper pedal (hereinafter, referred to as "pedal" simply) 7. The panel 5 is provided with switches, etc., for setting various states including a tone switch 5*a* for selecting a tone of music sounds to be generated, and information set from this panel 5 is supplied to the CPU 1. The pedal 7 is provided with a pedal sensor 7*a* consisting of, for example, a variable resistor, and a voltage signal corresponding to a resistance of the variable resistor which changes according to an operation (stepping) state of the pedal 7 is inputted as pedal information showing a stepped amount or depth of the pedal 7 into the CPU 1. When receiving the input of the pedal information (operation device information), the CPU 1 sets a resonance setting flag provided on the RAM 4 to "1." Then, based on the pedal information, when the CPU 1 judges that the stepped amount of the pedal 7 reaches "0," the resonance setting flag is reset to "0."

The keyboard 8 includes 88 keys of A0 through C8, and key-pressing information of each key of the keyboard 8 is detected by a keyboard scanning circuit that is not shown. Each key is provided with a touch sensor, that is, a key switch 8*a*. The key switch 8*a* detects a player's playing operation on the keyboard 8 and outputs key-pressing information such as a key code KC indicating the pitch of a pressed key, key-on KON and key-off KOFF for instructing music sound producing and vanishing timings according to key-pressing and key-releasing, and key touch KT corresponding to a key-pressing speed. The information outputted from the key switch 8*a* is supplied to the CPU 1 via the system bus 2.

The music sound generating unit 9 or a tone generator is equipped with a plurality of channels which are subjected to time sharing control so as to simultaneously produce a plurality of sounds, and accumulates output signals from all of the plurality of channels and outputs it. In the music sound generating unit 9, by using any of the channels assigned by the key-pressing operation, a normal music sound and a cabinet resonance corresponding to a key-pressing operation, and a released key string vibration sound corresponding to a key-releasing operation or a pedal operation are generated.

In the waveform memory 10, waveform data of normal music sounds and cabinet resonances are stored. Waveform data of the normal music sounds is data which consists of frequency information and amplitude information of music sound waveforms recorded or waveform-synthesized and are prepared according to a known method.

On the other hand, to prepare waveform data of the cabinet resonances, a resonance circuit of open strings for the upper register, fore strings, and back strings is designed, and waveform data of the cabinet resonances are obtained by inputting normal music sounds into the resonance circuit. Then, waveform data outputted from this resonance circuit is subjected to loop processing and stored in the waveform memory 10. The resonance circuit can be constructed so that its impulse response is imitated according to a single-degree-of freedom system model with viscous damping of a vibration waveform of harmonic overtone. For the single-degree-of freedom system model with viscous damping, Japanese Patent Applications No. 2006-11469 and No. 2006-11470 applied by the present applicant are quoted herein for reference. The waveform data of the cabinet resonances may be sampled by installing a microphone near the strings normally opened of an acoustic piano.

The music sound generating unit 9 reads waveform data stored in the waveform memory 10 at a pitch corresponding to the key code KC, and based on this waveform data, generates a music sound signal of a normal music sound and a music sound signal of a cabinet resonance, and generates a music sound signal of a released key string vibration sound by filtering the waveform data of the normal music sound with a band-pass filter (BPF).

The music sound signals of the normal music sound, the released key string vibration sound, and the cabinet resonance are synthesized and converted into an analog signal by a D/A converter 12, and then inputted into a sound system 13. The sound system 13 consists of an amplifier and a speaker, etc., and produces sounds of the output signal of the D/A converter as an output of the electronic piano to the outside.

Figure 1:
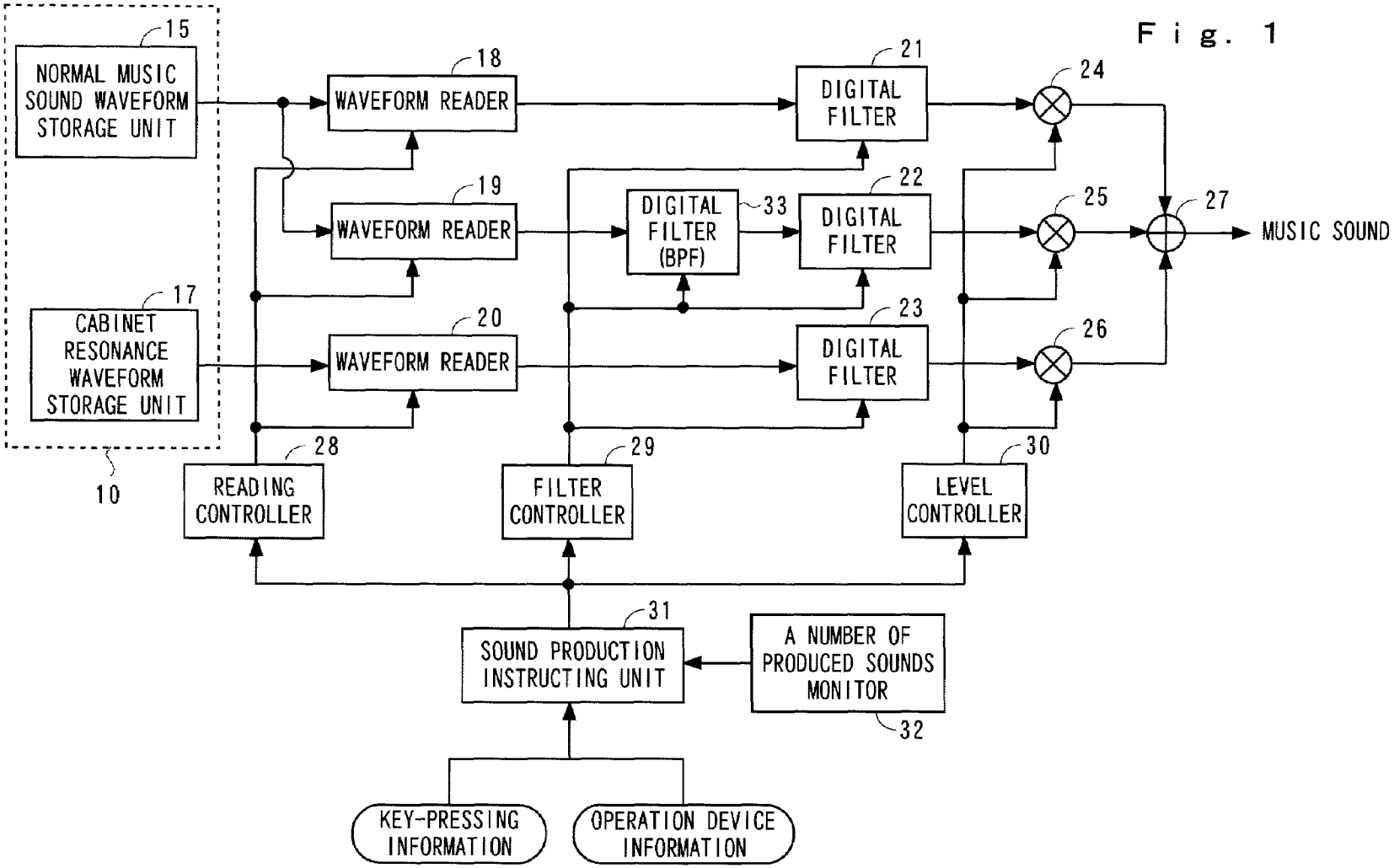
FIG. 1 is a block diagram showing main portion functions of a music sound generator relating to an embodiment of the present invention.

FIG. 1 is a block diagram showing a main portion construction of the music sound generating unit 9. The normal music sound waveform storage unit (normal music sound waveform storing means) 15 and the cabinet resonance waveform storage unit (cabinet resonance waveform storing means) 17 are waveform data storing areas set inside the waveform memory 10. In the normal music sound waveform storage unit 15, normal music sound data is stored in advance, and in the cabinet resonance waveform storage unit 17, cabinet resonance waveform data is stored in advance.

Among these waveform data, the normal music sound waveform data is readout by waveform readers 18 and 19. The normal music sound waveform data readout by the waveform reader 18 is inputted into a multiplier 24 through a digital filter 21.

On the other hand, the normal music sound waveform data readout by the waveform reader 19 is inputted into a multiplier 25 through a released key string vibration sound generating digital filter (band-pass filter) 33 on the fore stage as a released key string vibration sound signal generating means and a digital filter 22 on the rear stage. The cabinet resonance waveform data is readout by a waveform reader 20 and inputted into a multiplier 26 through a digital filter 23. On the rear stage of the multipliers 24, 25, and 26, an adder (adding means) 27 is provided.

The digital filters 21, 22, and 23 as a plurality of filter means filter the respective inputted waveform data according to a pressed key (key number and key touch) based on a predetermined cut-off frequency, and adjust harmonic components and harmonic overtone components. The digital filters 21, 22, and 23 have a known function of controlling the tone according to the tone switch.

The band-pass filter 33 is a released key string vibration sound signal generating filter for forming waveform data of a released key string vibration sound from the normal music sound waveform data, and can consist of a band-pass filter which stresses the middle band by erasing low-order harmonic overtones and high-order harmonic overtones from the normal music sound waveform data. Instead of the band-pass filter, a finite impulse response filter (FIR) can be used.

The waveform reader 18, the digital filter 21, and the multiplier 24 constitutes a normal music sound signal generating means, and the waveform reader 20, the digital filter 23, and the multiplier 26 constitute a cabinet resonance signal generating means.

A sound production instructing unit 31 gives a sound start instruction to a reading controller 28, a filter controller 29, and a level controller 30 based on key-pressing information and operation device information, that is, a value of a resonance setting flag on the RAM 4 showing a pedal stepped state.

The sound production instructing unit 31 provides the reading controller 28 with a sound production instruction in response to key-on KON. The reading controller 28 provides the waveform readers 18, 19, and 20 with a reading instruction according to a sound production instruction.

The filter controller 29 controls the cut-off frequencies of the digital filters 21 and 23 provided corresponding to the normal music sound and the cabinet resonance, respectively, based on a sound start instruction or a sound stop instruction sent from the sound production instructing unit 31. These cut-off frequencies are maintained high from the beginning of sound production.

The filter controller 29 controls the cut-off frequency of the digital filter 22 provided corresponding to the released key string vibration sound based on a sound start instruction or a sound stop instruction sent from the sound production instructing unit 31. The cut-off frequency of the digital filter 22 is set to be sufficiently low when starting sound production, and is returned to normal higher frequency when stopping the sound production. When the cut-off frequency is returned to normal higher frequency, a released key string vibration sound is generated according to a released key string vibration sound signal outputted at this time from the band-pass filter 33.

The level controller 30 determines envelope data for providing the waveform data outputted from the digital filters 21, 22, and 23 with envelopes, and inputs these into the multipliers 24, 25, and 26, respectively. The envelope data is determined based on key-pressing information, and after key-releasing, according to the state of the pedal 7, envelope data for attenuating the normal music sound, the released key string vibration sound, and the cabinet resonance at attenuation rate set in advance for the respective sounds are determined.

At the time of key-releasing, when the pedal 7 is off, envelope data is determined so as to attenuate the normal music sound, the released key string vibration sound, and the cabinet resonance attenuate at mutually different attenuation rate unique to the respective sounds. At the time of key-releasing, when the pedal 7 is on, the damper is raised and is not in contact with the strings, so that the sound production is continued without changing the envelope data of the normal music sound, the cabinet resonance, and the released key string vibration sound.

The waveform data processed by the digital filters 21, 22, and 23 are adjusted in level by the multipliers 24, 25, and 26, respectively, and then synthesized by the adder 27 and inputted into the D/A converter 12 (see FIG. 2).

A number of produced sounds monitor 32 monitors the numbers of produced sounds of the respective normal music sound, released key string vibration sound, and cabinet resonance, and according to the numbers of produced sounds, channel assignment is performed. In this embodiment, the number of channels that can be used for the released key string vibration sounds and cabinet resonances is set smaller than the number of channels for normal music sounds. That is, the number of sounds to be simultaneously produced of the released key string vibration sound generating means is set smaller than that of the normal music sound generating means. For example, fifty channels are assigned to the normal music sounds, and ten channels are assigned each to the released-key string vibration sounds and the cabinet resonances. Then, when the number of sounds produced is larger than these numbers of channels, any sound is vanished according to a predetermined standard. To imitate the released key string vibration sound or cabinet resonance which is not produced according to this sound vanishing, processing for lengthening the attenuation time of the normal music sound corresponding to the vanished sound is performed.

The waveform reader 19, the band-pass filter 33, the digital filter 22, and the multiplier 25 shown in FIG. 1 are not provided for all keys, but desirably, are provided for specific keys or a key range. For example, the upper register for which a damper is not provided may not be provided with the released key string vibration sound generating means.

Figure 3:
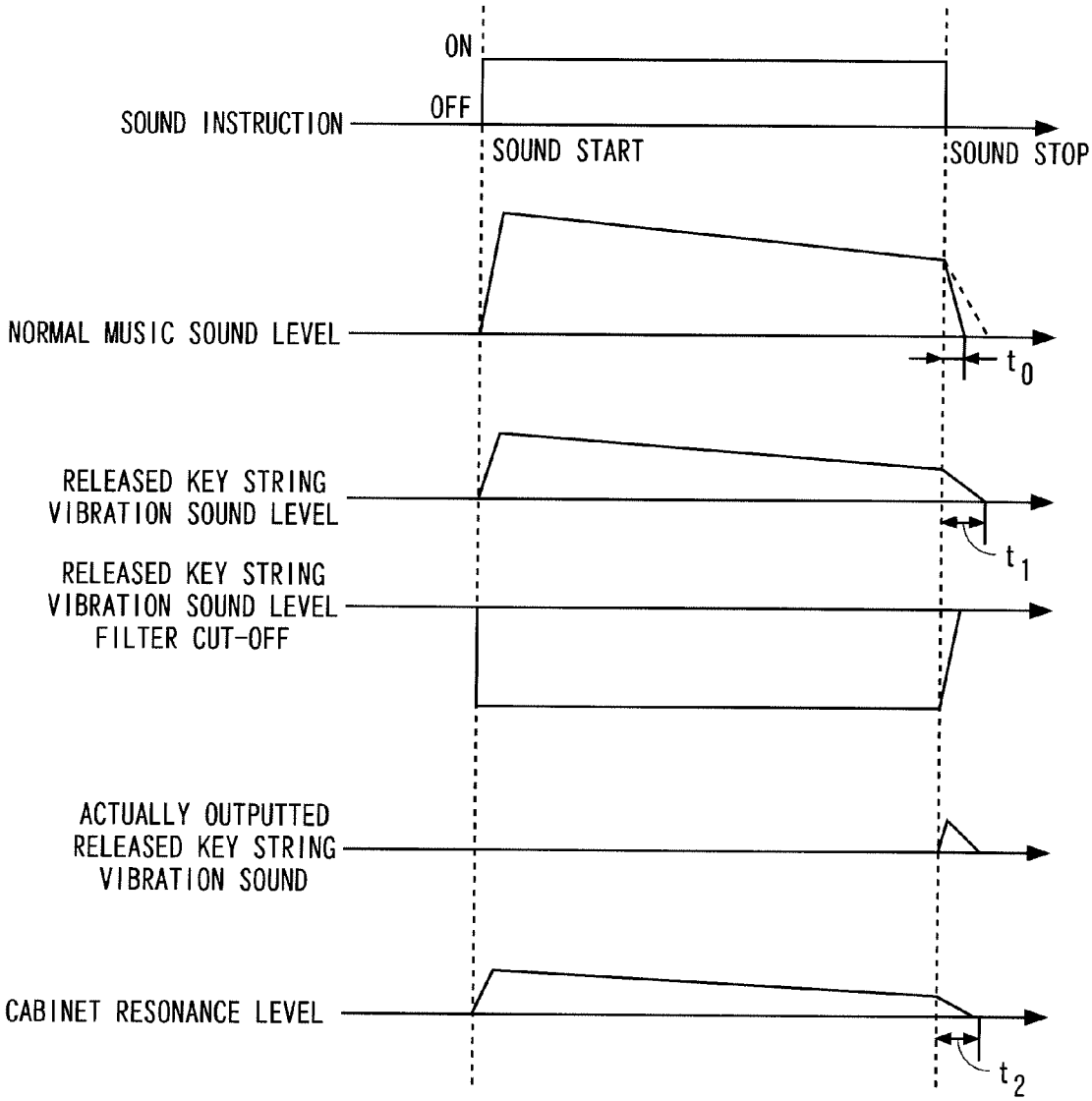
FIG. 3 is a timing chart of the music sound generator.

FIG. 3 is a timing chart of sound production relating to this embodiment. Operations based on the construction of FIG. 1 will be described with reference to FIG. 3. A sound production instruction is outputted based on key-pressing information and operation device information. In response to key-on KON of the key-pressing information, the sound production instruction is turned on, and when key-off KOFF of the key-pressing information and turning-off of the pedal 7 of the operation device information are detected, the sound production instruction is turned off. When the sound production instruction is turned off, the sound production is stopped and attenuation is started.

In response to turning-on of the sound production instruction, normal music sound waveform data is readout from the normal music sound waveform storage unit 15 to the digital filter 21 and the band-pass filter 33. Waveform data of a released key string vibration sound formed by filtering normal music sound waveform data readout to the band-pass filter 33 is inputted into the digital filter 22. In response to turning-on of the sound production instruction, cabinet resonance waveform data is readout from the cabinet resonance waveform storage unit 17 to the digital filter 23. The normal music sound, the released key string vibration sound, and the cabinet resonance are changed in level according to the envelopes shown in FIG. 3 by the multipliers 24, 25, and 26, and envelope data are set so that the sounds attenuate at predetermined attenuation rate in response to the turning-off of the sound production introduction and then the sounds attenuate.

Herein, the cut-off frequency of the digital filter 22 for the released key string vibration sound is set to be sufficiently lower than normal in response to the turning-on of the sound production instruction, and is returned to normal on condition of turning-off of the sound production instruction. Therefore, the readout waveform data of the released key string vibration sound is not outputted from the digital filter 22 during production of normal music sounds due to the cut-off frequency. When the cut-off frequency is returned to normal by turning-off of the sound production instruction, sound production is started at the level of the released key string vibration sound readout at this time, and the sound is attenuated based on the attenuation rate.

A waveform of a released key string vibration sound to be outputted in actuality is shown on the second stage from the bottom of FIG. 3. When the cut-off frequency is returned to normal by turning-off of the sound production instruction, the outputted sound waveform starts rising, so that there is a slight delay until the sound output level becomes sufficiently high. However, the sound output level of the released-key string vibration sound becomes high until the normal sound level reaches zero, so that said delay does not pose a problem in actuality. The attenuation rate is set so that attenuation time T1 of the released key string vibration sound becomes longer than the attenuation time T0 of the normal music sound, so that even after the normal music sound attenuates, the released key string vibration sound continues attenuating during the time (T1-T0), and is slightly produced.

In an acoustic piano, when a key is pressed and then immediately released, the damper comes into contact with the strings while the string vibration is great immediately after the key is pressed, so that the released key string vibration sound is loud and includes many harmonic overtones. On the other hand, when a key is pressed and then released after a while, the damper comes into contact with the strings in a state that the string vibration is small, so that the released key string vibration sound is less and includes small harmonic overtones. That is, the key-releasing string vibration sound changes according to the key-releasing timing.

On the other hand, the waveform data of the released key string vibration sound formed based on normal music sound waveform data concurrently with key-pressing is not used for actual sound production, however, it changes along with time elapse after key-pressing. Therefore, a released key string vibration sound can be generated with optimal waveform data suitable for the timing of key-releasing, and the attenuation time is also controlled by control of the level controller 30. In an acoustic piano, when a key is released after a long time elapses since pressing of the key, the string vibration becomes extremely small, and even when the damper comes into contact with the strings due to key-releasing, a released key string vibration sound is hardly generated. According to this embodiment, the state in this case can be reproduced.

When reading out the normal music sound waveform data to the waveform reader 19 to generate a released key string vibration sound, instead of reading the waveform data from its head similarly to reading of the normal music sound waveform data to the waveform reader 18 for normal music sound production, the reading start point may be shifted to a position slightly ahead of the head. The reason for this is that the impact sound of key-pressing is not necessary for forming the released key string vibration sound. Thus, by reading the rear portion of the waveform data with a stable string vibration sound by avoiding a portion with a great change in tone at the rise of the normal music sound waveform, when it is subjected to filtering by the band-pass filter 33, a waveform more approximate to an actual released key string vibration sound can be obtained. It is also allowed that only the loop portion of the normal music sound waveform data is readout to the band-pass filter 33.

The cut-off frequency of the cabinet resonance is set to a normal level from the beginning of key-pressing similar to the normal music sound, so that as shown in FIG. 3, it is produced at a level smaller than the normal music sound since key-pressing. The attenuation rate is set so that the attenuation time T2 becomes longer than the attenuation time T0 of the normal music sound, so that the cabinet resonance is maintained during the time (T2-T0) after the normal music sound attenuation.

The cabinet resonance is not always generated since key-pressed, and similarly to the released key string vibration sound, it is also allowed that the cut-off frequency of the digital filter 23 is made sufficiently low, and at the time of key-releasing, the cut-off frequency is returned to the normal high value. By starting production of the cabinet resonance at the time of key-releasing, the stressing effect of the cabinet resonance can be increased.

In the envelope (normal music sound level) of the normal music sound of FIG. 3, the dotted line that shows an attenuation state after a sound stop instruction corresponds to an attenuation time of the normal music sound elongated when the released key string vibration sound generating means is short of an unused channel or the cabinet resonance generating means is short of an unused channel. This elongated attenuation time of the normal music sound enables imitation of the released key string vibration sound and cabinet resonance if unused channel is not left.

Figure 4:
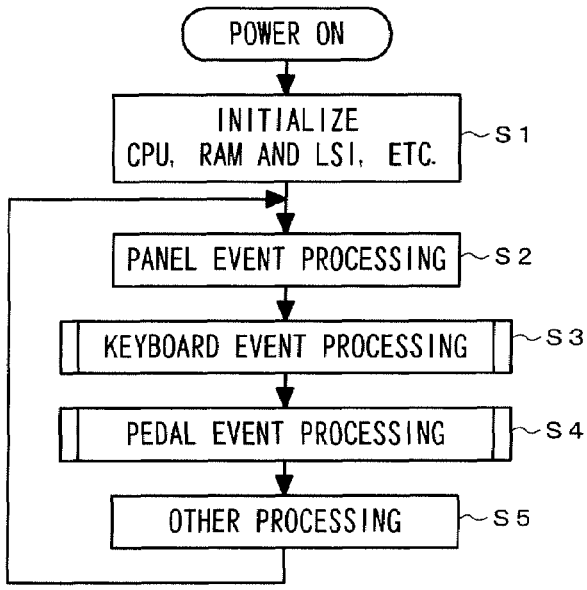
FIG. 4 is a flowchart showing main processing of the music sound generator.

Next, keyboard event processing including truncation processing according to the number of sounds produced by the number of produced sounds monitor 32 will be described with reference to the flowcharts. First, FIG. 4 is a flowchart showing entire processing. At Step S1, the CPU 1, RAM 4, and sound source LSI (DSP), etc., are initialized. At Step S2, panel event processing in which states of the switches, etc., on the panel 5 are read and corresponding processing is performed. At Step S3, keyboard event processing for generating a music sound signal of a normal sound based on an output of the key switch 8*a* is executed. The keyboard event processing includes envelope setting according to the key touch KT.

At Step S4, pedal event processing corresponding to an output of the pedal sensor 7*a* is performed. The pedal event processing may include processing for pedals other than the pedal (damper pedal). At Step S5, other processings are performed.

Figure 5:
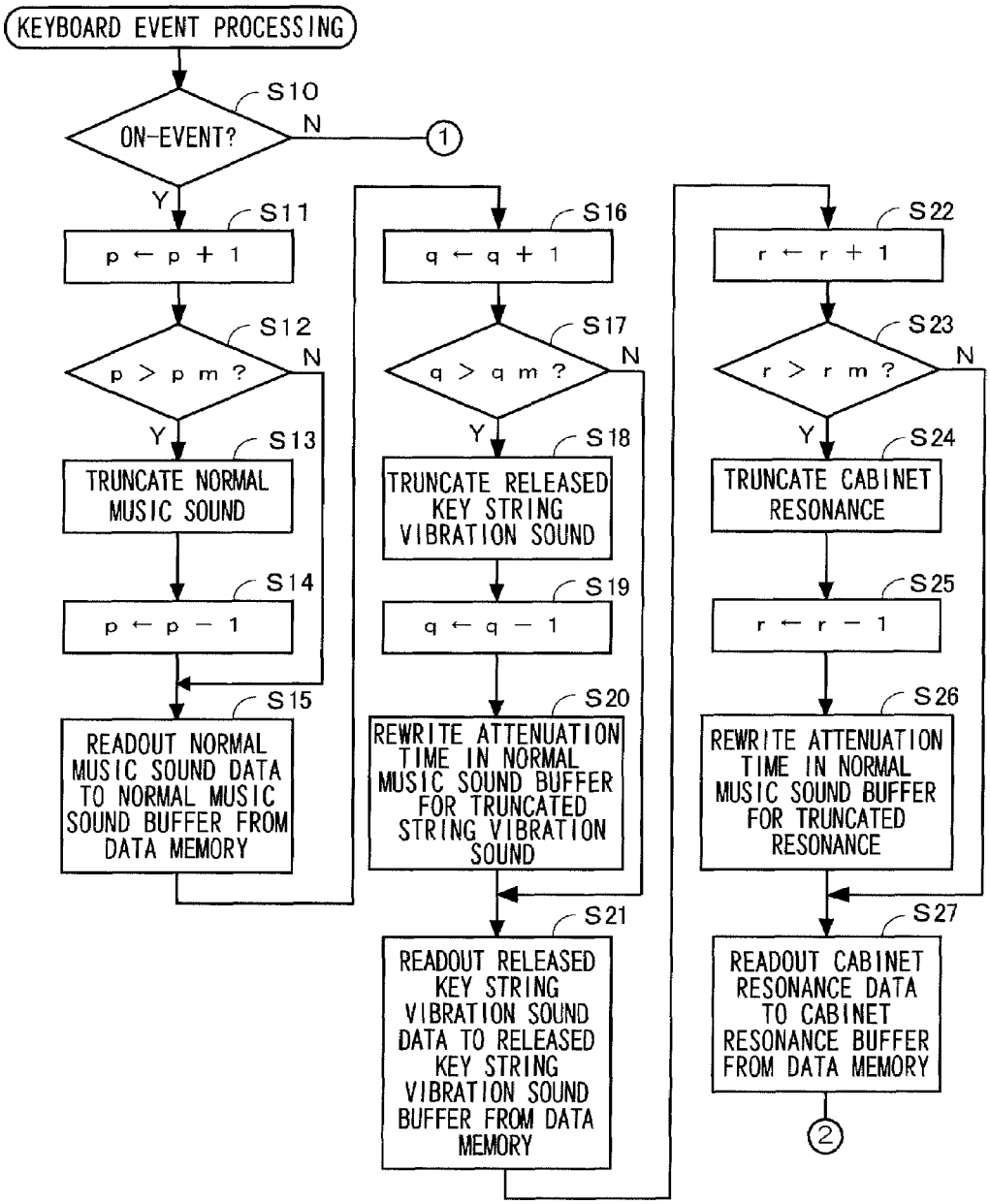
FIG. 5 is a flowchart showing keyboard event processing (1)
Figure 6:
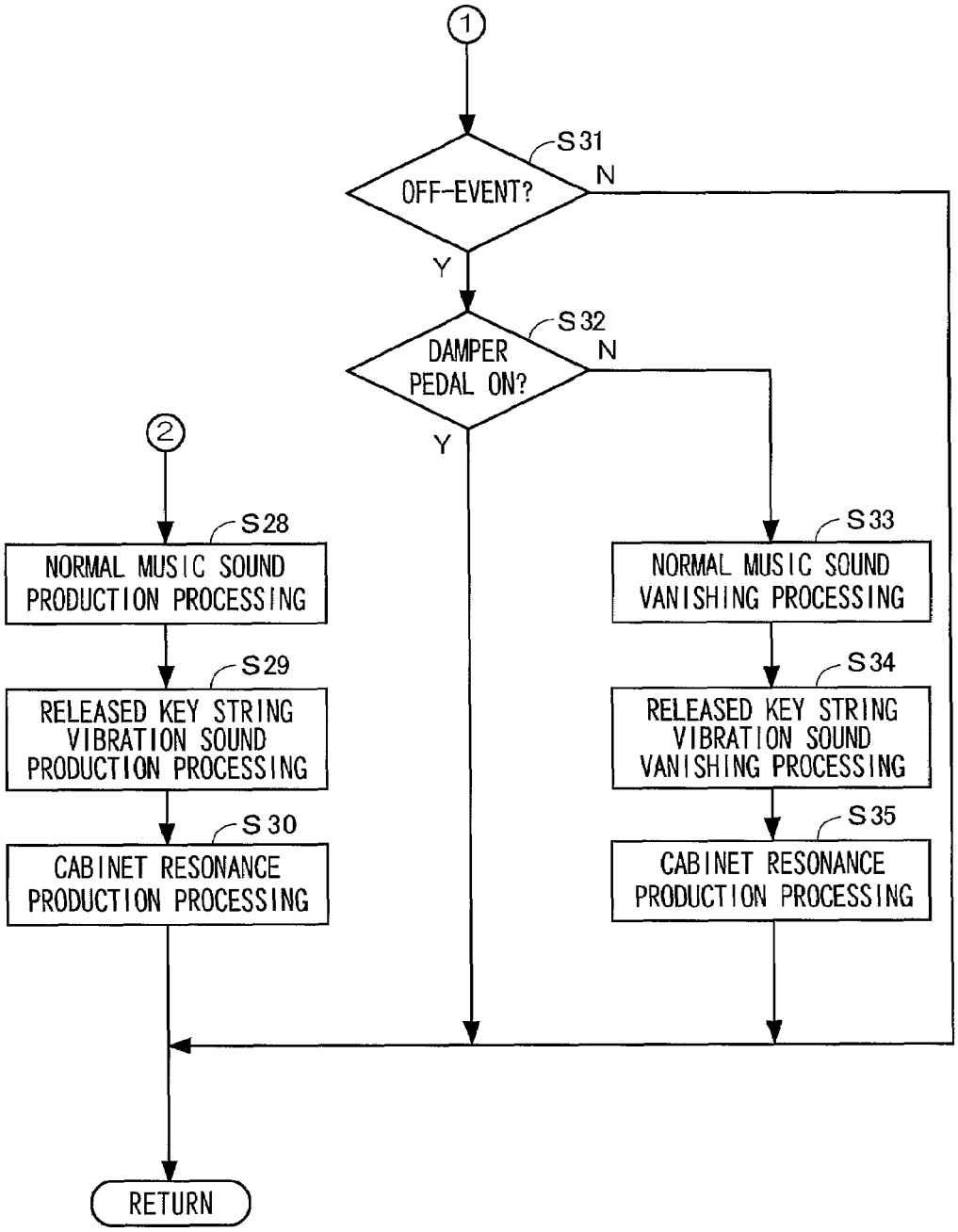
FIG. 6 is a flowchart showing keyboard event processing (2)

FIG. 5 and FIG. 6 are flowcharts showing details of the keyboard event processing (step S3). In FIG. 5 and FIG. 6, a normal music sound buffer, a released key string vibration sound buffer, and a cabinet resonance buffer are areas of the RAM which temporarily store envelopes of the normal music sound, the released key string vibration sound, and the cabinet resonance and cut-off frequencies of the digital filters, and an address, etc., of the waveform memory 10, and attenuation rate when sound production is stopped, is also stored therein.

First, at Step S10 of FIG. 5, according to the presence of the key-on KON, the presence of an ON-event of the keyboard 8 is judged, that is, it is judged whether there is a key pressed. When there is an ON-event, the process advances to Step S11, and the counter value P counting the number of channels producing sounds of the normal music sound is incremented. At Step S12, it is judged whether the number p of channels producing sounds is the maximum number pm of sound producing channels When the answer for Step S12 is affirmative, it is judged that no unused channel is left, and the process advances to Step S13. At Step S13, to empty a channel, truncation processing for canceling the assignment of one of the channels producing normal music sounds is performed. As an object to be subjected to this truncation processing, for example, priority is placed on later pressing, and channels are emptied in descending order of length of the sound production time. At Step S14, according to the emptied channel, the counter value p is decremented, and the process advances to Step S15.

When the answer for Step S12 is negative, it is judged that an unused channel is left, and it is not necessary to empty a channel, so that the process skips Steps S13 and S14 and transfers to Step S15.

At Step S15, normal music sound data corresponding to an ON event (for generating a normal music sound) of Step S10 is readout to the normal music sound buffer from the data memory 3*b*.

At Step S16, the counter value p counting the number of channels being producing released key string vibration sounds is incremented. At Step S17, it is judged whether the number q of channels producing the sounds is not less than the maximum number qm of channels producing sounds of the released key string vibration sounds.

When the answer for Step S17 is affirmative, it is judged that no unused channel is left, and the process advances to Step S18. At Step S18, to empty a channel, truncation processing for stopping production of one of the released key string vibration sounds being produced is performed. As an object to be subjected to this truncation processing, for example, either one set in advance of the later-pressed sound priority or the lower pitch sound priority is applied. The reason for the lower pitch sound priority is that the lower pitch sound has a greater amplitude of string vibration and a remarkable string vibration sound.

At Step S19, according to an emptied channel, the counter value q is decremented. At Step S20, the attenuation time set in the normal music sound buffer for the truncated string vibration sound is rewritten to be longer, and the process advances to Step S21.

When the answer for Step S17 is negative, it is judged that an unused channel is left, and it is not necessary to empty a channel, so that the process skips Steps S18 through S20 and transfers to Step S21.

At Step S21, released key string vibration sound data corresponding to the ON event of Step S10 is readout to the released key string vibration buffer from the data memory 3*b*.

At Step S22, a counter value r counting the number of channels producing cabinet resonances is incremented. At Step S23, it is judged whether the number r of channels whose sounds are being produced is not less than a maximum number rm of sound producing channels of cabinet resonances.

When the answer for Step S23 is affirmative, it is judged that no unused channel is left, and the process advances to Step S24. At Step S24, to empty a channel, truncation processing for canceling assignment of one of the channels producing cabinet resonances is performed. As an object to be subjected to this truncation processing among the cabinet resonances, for example, priority is placed on a later-pressed sound or a higher pitch sound. The reason for this is that the cabinet resonance is heard well on the higher pitch side. At Step S25, a counter value T is decremented according to the emptied channel. At Step S26, the attenuation time set in the normal music sound buffer for the truncated resonance is rewritten to be longer, and the process advances to Step S27.

When the answer for Step S23 is negative, it is judged that an unused channel is left, and it is not necessary to empty a channel, so that the process skips Steps S24 through S26 and transfers to Step S27.

At Step S27, cabinet resonance data corresponding to the ON event of Step S10 is readout to the cabinet resonance buffer from the data memory 3*b*.

When the answer for Step S23 is negative, it is judged that an unused channel is left, so that the process skips Steps S24 through S26 and transfers to Step S27, and data for released key string vibration sound production is readout to the unused channel from the cabinet resonance buffer.

At Step S28 of FIG. 6, by using waveform data readout to the normal music sound waveform storage unit 15, normal music sound production processing is performed according to the construction and operations described in FIG. 1. Similarly, at Step S29, released key string vibration sound production processing is performed by using released key string vibration sound waveform data generated from the waveform data readout to the normal music sound waveform storage unit 15, and at Step S30, cabinet resonance production processing is performed by using the waveform data readout to the cabinet resonance waveform storage unit 17.

When the judgment of Step S10 of FIG. 5 is negative, the process advances to Step S31 of FIG. 6, and according to presence of the key-off KOFF, the presence of an OFF event of the keyboard 8, that is, the presence of key-releasing is judged. In the case of key-releasing, the process advances to Step S32, and it is judged based on operation device information whether the pedal 7 is on. When the pedal 7 is not on, the process advances to Step S33 and sound vanishing processing of the normal music sound corresponding to the key-releasing is performed. At Step S34, sound vanishing processing of the released key string vibration sound corresponding to the key-releasing is performed. At Step S35, sound vanishing processing of the cabinet resonance corresponding to the key-releasing is performed.

Figure 7:
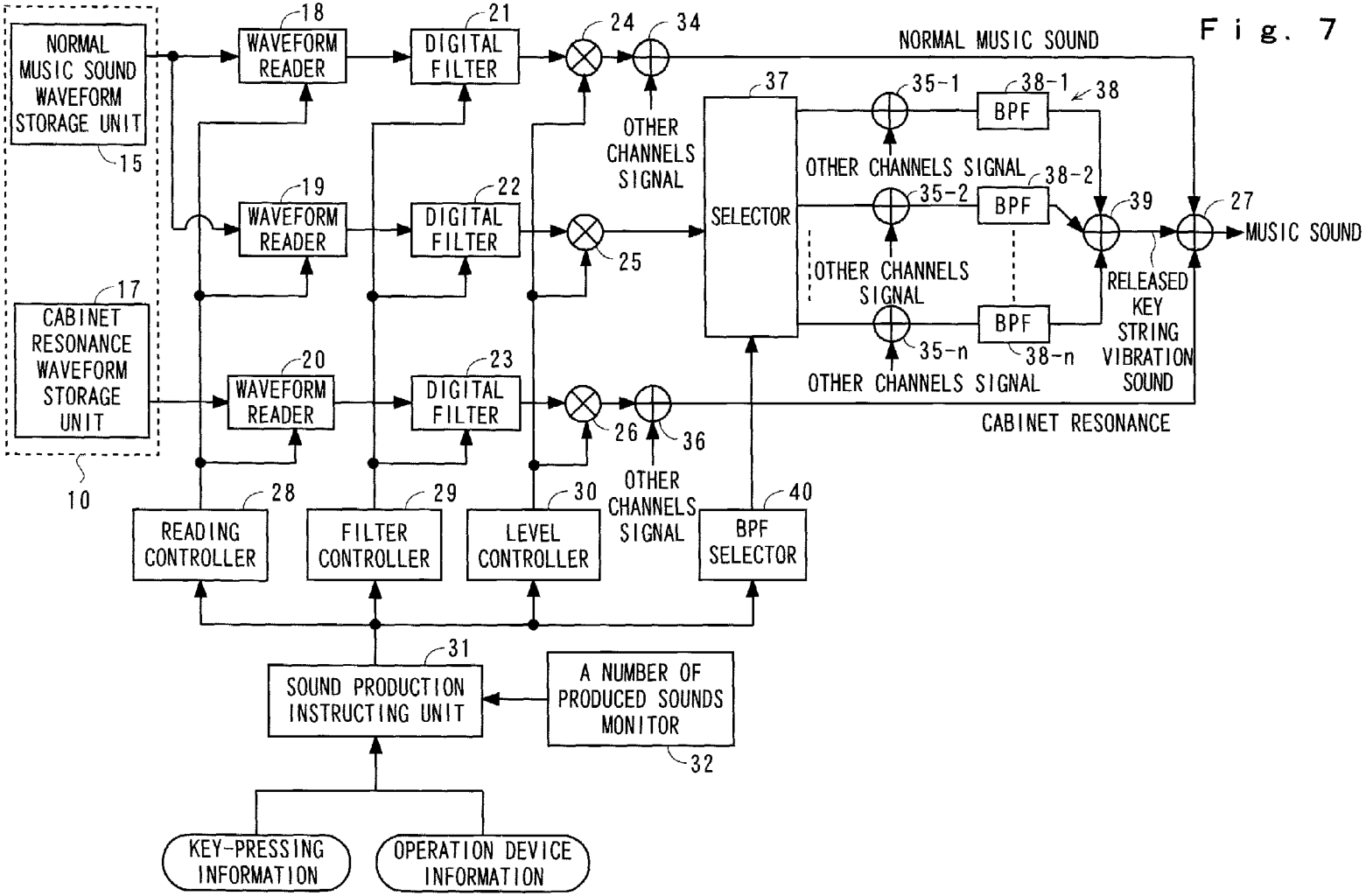
FIG. 7 is a block diagram showing main portion functions of a music sound generator of a second embodiment of the present invention.

FIG. 7 is a block diagram of a second embodiment of the present invention, wherein the same reference numerals show an identical or equivalent portion. In this second embodiment, normal music sound waveform data readout for released key string vibration sound creation is controlled in level after being subjected to filtering, and the level-controlled waveform data for all channels is added and mixed. Then, the added and mixed waveform data is filtered with a band-pass filter as a released key string vibration sound generating filter to create a released key string vibration sound signal.

In FIG. 7, to the first music sound signal generating means consisting of the digital filter 21 and the multiplier 24, a normal music sound waveform is readout by the waveform reader 18 from the normal music sound waveform storage unit 15. This normal music sound waveform is filtered with the digital filter 21 and provided with an envelope by the multiplier 24. An adder 34 provided on the output side of the multiplier 24 adds and mixes the normal music sound signal outputted from the multiplier 24 and normal music sound signals from all other channels for normal music sound signal generation.

To the cabinet resonance signal generating means consisting of the digital filter 23 and the multiplier 26, a cabinet resonance waveform is readout by the waveform reader 20 from the cabinet resonance waveform storage unit 17. This cabinet resonance waveform is filtered with the digital filter 23 and provided with an envelope by the multiplier 26. An adder 36 provided on the output side of the multiplier 26 adds and mixes the cabinet resonance signal outputted from the multiplier 26 and cabinet resonance signals from all other channels for cabinet resonance signal generation.

To the second normal music sound signal generating means consisting of the digital filter 22 and the multiplier 25, similar to the first normal music sound waveform means, a normal music sound waveform is readout from the normal music sound waveform storage unit 15 by the waveform reader 19. However, in this second normal music sound signal generating means, a normal music sound signal filtered with the digital filter 22 and provided with an envelope by the multiplier 25 is inputted into a selector 37. According to which of the plurality of registers set in advance the struck key belongs to, the selector 37 selects one of a plurality of band-pass filters 38 (38-1, 38-2 . . . **38-*n*) as a released key string vibration sound signal generating filter corresponding to the register. On the input sides of the respective band-pass filters 38-1, 38-2 . . . 38-*n*, adders 35 (35-1, 35-2 . . . 35-*n*) are provided. The adders 35 add and mix signals of all channels for released key string vibration sound production. The output side of the band-pass filter 38 is connected to the input side of the adder 39. The output side of the adder 39 is connected to the input side of an adder 27 as an all-music sound mixing means, and in the adder 27**, a normal music sound signal, a released key string vibration sound signal, and a cabinet resonance signal are added.

The first and second normal music sound signal generating means, the cabinet resonance signal generating means, and the selector 37 shown in FIG. 7 are provided for each channel. Normal music sound signals from selectors provided for other channels not shown are inputted into the adder 35, and normal music sound signals from the first normal music sound signal generating means provided for other channels not shown are inputted into the adder 34. Cabinet resonance signals from cabinet resonance signal generating means provided for other channels not shown are inputted into the adder 36.

The plurality of band-pass filters 38-1 through **38-*n* can consist of digital filters, and have filter characteristics (center frequencies and bandwidths) that are fixed, respectively, and mutually different. The provision of the plurality of band-pass filters with mutually different characteristics is for creating optimal released key string vibration sound waveform data for each register, and for this, a band-pass filter (BPF) selector 40 is provided. The band-pass filter selector 40 inputs an instruction of selecting one of the band-pass filters 38 for each predetermined register based on a key number inputted from the sound production instructing unit 31 into the selector 37**.

By providing the band-pass filters 38 fixedly after the signal mixing of the respective channels, in comparison with the provision of the band-pass filters before signal mixing of the respective channels, the number of band-pass filters can be reduced. The number of band-pass filters 38 depends on the set register, so that when one register is set, the number of band-pass filters 38 is one, and in this case, the band-pass filter selector 40 and the selector 37 may be omitted.

In each embodiment described above, an electronic piano is exemplified as a music sound generator, however, the present invention is not limited to the electronic piano, but can also be applied to other electronic instruments which provide effect sounds according to pedal operations without departing from the spirit of the present invention.

What is claimed is:

1. A music sound generator comprising:

a sound instructing means for outputting a sound start instruction based on key-pressing information and outputting a sound stop instruction based on the key-pressing information and operation device information;

a normal music sound waveform storing means for storing a normal music sound waveform;

a normal music sound signal generating means for generating a normal music sound signal by using the normal music sound waveform;

a released key string vibration sound signal generating means including a released key string vibration sound signal generating filter which generates a released key string vibration sound signal by filtering the normal music sound waveform;

a plurality of filtering means into which the normal music sound signal and released key string vibration sound signal are inputted, respectively; and an adding means for adding the normal music sound signal and the released key string vibration sound signal, wherein in response to the sound start instruction, reading of the normal music sound waveform to the released key string vibration sound signal generating filter from the normal music sound waveform storing means is started by sufficiently lowering a cut-off frequency of the released key string vibration sound signal by the plurality of filtering means, and wherein in response to the sound stop instruction, the sufficiently lowered cut-off frequency is raised and the normal music sound signal and the released key string vibration sound signal are attenuated according to predetermined envelopes.

2. The music sound generator according to claim 1, wherein the released key string vibration sound signal generating filter consists of a band-pass filter.

3. The music sound generator according to claim 1, wherein the released key string vibration sound signal generating filter consists of an finite impulse response filter.

4. The music sound generator according to claim 1, wherein the number of sounds simultaneously produced by the released key string vibration sounds is set to be smaller than the number of the normal music sounds.

5. The music sound generator according to claim 1, wherein when there are no vacant channels for the released key string vibration sound production, one of the released key string vibration sound signals the sounds of which are being produced is stopped, and when stopping production of the normal music sound signal the generation of which was started simultaneously with the stopped released key string vibration sound signal, an attenuation time is elongated and data of the normal music sound generating means relating to the attenuation time is changed is set.

6. The music sound generator according to claim 5, wherein shortage of the vacant channels is judged when a sound start instruction is outputted by the sound instructing means.

7. The music sound generator according to claim 5, wherein when vacant channels are in short supply, among the released key string vibration sound signals the sounds of which are being produced, either one of the released key string vibration sound signal of the highest register or a released key string vibration sound signal instructed to start producing an earliest sound is stopped.

8. The music sound generator according to claim 1, wherein filtering by the released key string vibration sound signal generating filter is performed for key-pressing of a preset specific key or key range.

9. The music sound generator according to claim 1, wherein an envelope is provided which makes longer an attenuation time of the released key string vibration sound signal that is attenuated in response to the sound stop instruction than an attenuation time of the normal music sound signal.

10. The music sound generator according to claim 1, further comprising:

a cabinet resonance waveform storing means for storing a cabinet resonance waveform; and a cabinet resonance signal generating means for generating a cabinet resonance signal by using the cabinet resonance waveform, wherein a signal outputted from the cabinet resonance signal generating means is further inputted into the adding means, and wherein in response to the sound start instruction, reading of the normal music sound waveform and a cabinet resonance waveform from the normal music sound waveform storing means and the cabinet resonance waveform storing means is started.

11. The music sound generator according to claim 10, wherein the cabinet resonance signal generating means is provided by a preset specific key or key range.

12. The music sound generator according to claim 10, wherein an attenuation time of the cabinet resonance signal that is attenuated in response to the sound stop instruction is made longer than that of the normal music sound signal.

13. The music sound generator according to claim 10, wherein the cabinet resonance waveform is synthesized according to a single-degree-of freedom system model with viscous damping.

14. The music sound generator according to claim 1, wherein a time of starting to read the normal music sound waveform from the normal music sound waveform storing means for generating the released key string vibration sound signal is delayed to be later than a time of starting to read the normal music sound waveform from the normal waveform storing means for generating a normal music sound signal.

15. A music sound generator comprising:

a sound instructing means for outputting a sound start instruction based on key-pressing information and outputting a sound stop instruction based on the key-pressing information and operation device information;

a normal music sound waveform storing means for storing a normal music sound waveform;

a first normal music sound signal generating means for generating a first normal music sound signal by filtering the normal music sound waveform and providing it with an envelope;

a second normal music sound signal generating means for generating a second normal music sound signal by filtering the normal music sound waveform and providing it with an envelope;

released key string vibration sound signal generating means which are provided corresponding to a plurality of registers set in advance, and each consists of a normal music sound signal mixing means for adding the second normal music sound signal of all channels generated in the second normal music sound signal generating means, and a released key string vibration sound signal generating filters with different filter characteristics different for each register for generating a released key string vibration sound signal from the normal music sound signals added by the normal music sound signal adding means;

a selecting means for inputting the second normal music sound signal generated by the second normal music sound signal generating means into the released key string vibration sound signal generating means corresponding to a register determined based on a key number included in the sound start instruction; and a music sound signal adding means for adding the first normal music sound signal outputted from the first normal music sound signal generating means and the released key string vibration sound signal outputted from the released key string vibration sound signal generating means, wherein in response to the sound start instruction, reading of the normal music sound waveform to the second normal music sound signal generating means from the normal music sound waveform storing means is started by sufficiently lowering a cut-off frequency of the normal music sound signal in filtering in the second normal music sound signal generating means, and wherein in response to the sound stop instruction, the sufficiently lowered cut-off frequency is raised and the normal music sound signal and the released key string vibration sound signal are attenuated according to predetermined envelopes.

16. The music sound generator according to claim 15, further comprising:

a cabinet resonance waveform storing means for storing a cabinet resonance waveform; and a cabinet resonance signal generating means for generating a cabinet resonance signal by using the cabinet resonance waveform, wherein into the music sound signal mixing means, a signal outputted from the cabinet resonance signal generating means is further inputted, and wherein in response to the sound start instruction, reading of the normal music sound waveform and a cabinet resonance waveform from the normal music sound waveform storing means and the cabinet resonance waveform storing means is started.

17. The music sound generator according to claim 10, wherein the number of sounds simultaneously produced by the cabinet resonances is set to be smaller than the number of the normal music sounds.

18. The music sound generator according to claim 16, wherein the number of sounds simultaneously produced by the cabinet resonances is set to be smaller than the number of the normal music sounds.

19. The music sound generator according to claim 10, wherein when there is no unused channel in the cabinet resonance signal generating means, one of the cabinet resonance signals the sounds of which are being produced is stopped, and data on the attenuation time of the normal music sound is changed to elongate the attenuation time at the time of sound stop of the normal music sound signal that was started to be generated simultaneously with the stopped cabinet resonance signal.

20. The music sound generator according to claim 16, wherein when there is no unused channel in the cabinet resonance signal generating means, one of the cabinet resonance signals the sounds of which are being produced is stopped, and data on the attenuation time of the normal music sound is changed to elongate the attenuation time at the time of sound stop of the normal music sound signal that was started to be generated simultaneously with the stopped cabinet resonance signal.

21. The music sound generator according to claim 19, wherein shortage of the vacant channel is judged when the sound start instruction is outputted by the sound instructing means.

22. The music sound generator according to claim 20, wherein shortage of the vacant channel is judged when the sound start instruction is outputted by the sound instructing means.

23. The music sound generator according to claim 19, wherein when there is no vacant channel among cabinet resonance signals the sounds of which are being produced, either one of a lowest pitch cabinet resonance signal or an earliest cabinet resonance signal instructed to start producing a sound is stopped.

24. The music sound generator according to claim 20, wherein when there is no vacant channel among cabinet resonance signals the sounds of which are being produced, either one of a lowest pitch cabinet resonance signal or an earliest cabinet resonance signal instructed to start producing a sound is stopped.

25. The music sound generator according to claim 21, wherein when there is no vacant channel among cabinet resonance signals the sounds of which are being produced, either one of a lowest pitch cabinet resonance signal or an earliest cabinet resonance signal instructed to start producing a sound is stopped.

26. The music sound generator according to claim 22, wherein when there is no vacant channel among cabinet resonance signals the sounds of which are being produced, either one of a lowest pitch cabinet resonance signal or an earliest cabinet resonance signal instructed to start producing a sound is stopped.

27. The music sound generator according to claim 16, wherein the cabinet resonance signal generating means is provided by a preset specific key or key range.

28. The music sound generator according to claim 16, wherein an attenuation time of the cabinet resonance signal that is attenuated in response to the sound stop instruction is made longer than that of the normal music sound signal.

29. The music sound generator according to claim 16, wherein the cabinet resonance waveform is synthesized according to a single-degree-of freedom system model with viscous damping.

30. A music sound generator comprising:

a sound instructing means for outputting a sound start instruction based on key-pressing information and outputting a sound stop instruction based on the key-pressing information and operation device information;

a normal music sound waveform storing means for storing a normal music sound waveform;

a normal music sound filter for filtering the normal music sound waveform;

a normal music sound envelope providing means for providing an output signal of the normal music sound filter with an envelope;

a released key string vibration sound signal generating filter which generates a released key string vibration sound signal by filtering the normal music sound waveform;

a released key string vibration sound filter for filtering the released key string vibration sound signal;

a released key string vibration sound envelope providing means for providing an output signal of the released key string vibration sound filter with an envelope; and an adding means for adding output signals of the normal music sound envelope providing means and the released key string vibration envelope providing means to generate a music sound signal, wherein in response to the sound start instruction, reading of the normal music sound waveform from the normal music sound waveform storing means is started by setting a cut-off frequency of the released key string vibration sound filter to be sufficiently lower than a normal cut-off frequency set in the normal music sound filter, and wherein in response to the sound stop instruction, a cut-off frequency of the released key string vibration sound filter to the normal cut-off frequency, and output signals of the normal music sound filter and the released key string vibration sound filter are attenuated according to predetermined envelopes.

* * * * *